United States Patent [19]

Kuehler

[11] 4,325,801

[45] * Apr. 20, 1982

[54] THREE-STAGE COAL LIQUEFACTION PROCESS

[75] Inventor: Christopher W. Kuehler, Larkspur, Calif.

[73] Assignee: Chevron Research Company, San Francisco, Calif.

[ * ] Notice: The portion of the term of this patent subsequent to Nov. 17, 1998, has been disclaimed.

[21] Appl. No.: 183,114

[22] Filed: Sep. 10, 1980

Related U.S. Application Data

[63] Continuation-in-part of Ser. No. 106,580, Dec. 26, 1979.

[51] Int. Cl.[3] ..... C10G 1/06; C10G 1/00

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 3,143,489 | 8/1964 | Gorin | 208/8 |
| 3,488,279 | 1/1970 | Schulman | 208/10 |
| 4,085,032 | 4/1978 | Acgel et al. | 208/10 |
| 4,085,033 | 4/1978 | Plumlee | 208/10 |
| 4,123,347 | 10/1978 | Maa | 208/10 |

*Primary Examiner*—Delbert E. Gantz
*Assistant Examiner*—William G. Wright
*Attorney, Agent, or Firm*—D. A. Newell; W. H. Hooper; A. H. Uzzell

[57] ABSTRACT

Disclosed is a three-stage process for liquefying coal in which a coal-solvent slurry is sequentially passed through a first dissolving stage and two catalytic reaction stages in series. The first catalytic reaction stage contains a catalyst having a selectivity for converting heptane insolubles to lower molecular weight compounds and a portion of the effluent from said stage is recycled for use as solvent in the dissolver. The second catalytic reactor is operated under hydrocracking conditions.

3 Claims, 1 Drawing Figure

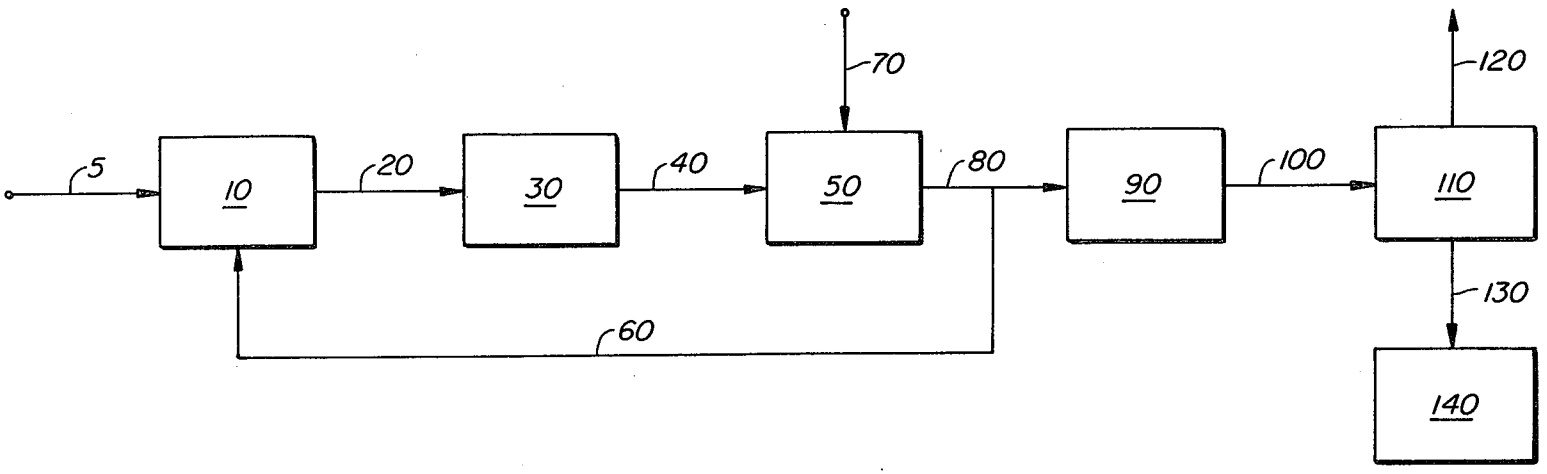
5
10
20
30
40
50
70
60
80
90
100
110
120
130
140

THREE-STAGE COAL LIQUEFACTION PROCESS

RELATED APPLICATION

This application is a continuation-in-part of application Ser. No. 106,580, filed Dec. 26, 1979, which is incorporated herein in its entirety by reference.

BACKGROUND OF THE INVENTION

1. Field of the Invention

The present invention relates to an improved process for liquefaction of raw coal. More particularly, the invention relates to a three-stage process employing a non-catalytic dissolution stage followed by two catalytic reaction stages. Effluent from the first catalytic reaction stage may be recycled for use as coal solvent.

2. Prior Art

Coal is our most abundant indigenous fossil fuel resource, and as a result of dwindling petroleum reserves, concerted research efforts are being directed toward recovery of liquid hydrocarbons from coal on a commercial scale. A promising approach in this field is the direct liquefaction of coal.

This approach has principally evolved from the early work of F. Bergius, who discovered that transportation fuels could be produced by the high pressure hydrogenation of a paste of coal, solvent and catalyst.

Later discoveries revealed the advantage of using specific hydrogenation solvents at lower temperatures and pressures. With these solvents, such as partially saturated polycyclic aromatics, hydrogen transfer to the coal is facilitated and dissolution enhanced. However, the products from single-stage dissolvers are typically high in asphaltenes, have high average molecular weights and high viscosities. These qualities present considerable obstacles in removing the final coal residue particles suspended in the product which usually range from 1 to 25 microns in diameter.

The complete nature of the coal residue or undissolved solids is not fully understood, but the residue appears to be a composite of organic and inorganic species. The residue organic matter is similar to coke and the inorganic matter is similar to the well known coal-ash constituents. The removal of these particles is, of course, necessary to produce a clean-burning, low-ash fuel.

As a result, numerous researchers have focused their efforts upon devising methods to facilitate residue removal by non-conventional techniques. One of the approaches advocated is the addition of precipitants or antisolvents to the residue laden product. Suitable precipitating agents include aliphatic or naphthenic hydrocarbons. These agents are miscible with the liquefaction solvent but do not dissolve the coal residue which is thereby precipitated. U.S. Pat. Nos. 3,852,182 and 4,075,080 incorporated herein by reference, are representative examples of the prior art teachings in this area. The use of such antisolvents or precipitating agents is expensive from both capital and operating standpoints, however, and the procedure still suffers from an additional disadvantage. The product liquids from single-stage dissolvers are usually high in asphaltenes which may be defined as benzene soluble and normal pentane insoluble materials. Although asphaltenes are soluble in the coal solvents employed, they tend to precipitate from the solution upon the addition of short-chain antisolvents. Although their precipitation aids in the agglomeration of the insoluble ash, it results in substantial product loss of the high-boiling fractions of the dissolved coal. A recognition of this problem and an attempt to solve it, is apty illustrated in U.S. Pat. No. 4,029,567, also incorporated herein by reference.

J. Gatsis and G. Tan, apparently recognizing the above problem, proceeded to attack it from a different angle in U.S. Pat. No. 4,081,360, incorporated herein by reference, by suppressing asphaltene formation during the coal liquefaction step. The patent teaches liquefying coal with a low asphaltene hydrogenated coal solvent and then adding a light aromatic solvent to aid in ash separation. Other teachings to the same effect include U.S. Pat. Nos. 3,997,045, 4,081,358, 4,081,359, 4,082,643, and 4,082,644.

Direct two-stage coal liquefaction processing evolved by the addition of a catalytic stage to further hydrogenate and break down the higher molecular weight products produced in the dissolver. In retrospect, and with the clarity hindsight often provides, such a step does not seem unprecedented. However, the direct passage of a solids-laden stream through a catalytic reactor was theretofore considered impractical at best. The two-stage units solved most of the coal residue removal problems since the hydrocracked product was relatively light and of relatively low viscosity, thereby permitting the use of conventional solids removal techniques and the asphaltene content of the product from the catalytic reactor was drastically reduced by the catalytically induced hydrogenation. Representative patents covering staged coal liquefaction processes include U.S. Pat. Nos. 4,018,663 issued to C. Karr, Jr. et al, U.S. Pat. No. 4,083,769 issued to R. Hildebrand et al and U.S. Pat. No. 4,111,788 issued to M. Chervenak et al.

U.S. Pat. No. 4,018,663 discloses a two-stage process in which a coal-oil slurry is passed through a first reactor containing a charge of porous, non-catalytic contact material in the presence of hydrogen at a pressure of 1,000 to 2,000 psig and a temperature of 400° to 450° C. The effluent from this reactor is then preferably filtered to remove the coal residue and passed to a catalytic reactor for desulfurization, denitrification and hydrogenation of the dissolved coal.

U.S. Pat. No. 4,083,769 discloses a process wherein a preheated coal-solvent slurry is passed with hydrogen through a first dissolver zone operated at a pressure in excess of 210 atmospheres and at a higher temperature than the preheater. The dissolver effluent is then hydrogenated in a catalytic zone also maintained at a pressure in excess of 210 atmospheres and at a temperature in the range of 370° to 440° C. to produce liquid hydrocarbons and a recycle solvent.

U.S. Pat. No. 4,111,788 discloses a process wherein a coal-oil slurry is passed through a dissolver containing no catalyst and the effluent therefrom is subsequently treated in a catalytic ebullated bed at a temperature at least 14° C. lower than the temperature of the dissolver. A portion of the product liquid is preferably recycled for use as solvent.

In each of the above processes, the coal is dissolved at high temperatures in the presence of hydrogen and/or a hydrogen-donor solvent. While the physical coal dissolution requires such temperatures, the residence times required for hydrogen transfer, coupled with the high temperatures, increase the overall gas yields at the expense of liquid product and increase hydrogen consumption.

SUMMARY OF THE INVENTION

The present invention provides a process for liquefying coal to produce normally liquid clean hydrocarbons accompanied by a minimum gas yield and minimum hydrogen consumption. In the process, a coal-solvent slurry is prepared by mixing particulate coal with a solvent that is provided by the process. The slurry is passed through a dissolving stage preferably free of external catalyst and contact particles to substantially dissolve said coal and produce an effluent containing heptane insolubles. Suitable operating conditions include, for example, a temperature in the range of 400° to 480° C. and at a slurry hourly space velocity in the range of 1 to 150 hrs.$^{-1}$. The effluent from the dissolving stage is then passed with added hydrogen through the first catalytic reaction stage containing a catalyst having a selectivity for converting heptane insoluble compounds to lower molecular weight compounds. The first catalytic reactor is preferably maintained at a temperature in the range of 340° to 430° C., a hydrogen partial pressure in the range of 35 to 700 atmospheres, and a slurry hourly space velocity in the range of 0.5 to 5 hrs.$^{-1}$. A portion of the effluent from the first reaction stage may be recycled with or without solids removal for use as a solvent in preparing the coal-solvent slurry. The remainder of the effluent from said first reaction stage passes through a second catalytic reaction stage containing hydrocracking catalyst and operating under hydrocracking conditions. An example of suitable hydrocracking conditions includes a hydrogen partial pressure in the range of 35 to 700 atmospheres and a temperature in the range of 340° to 430° C.

The catalyst used in the first reaction stage should have a selectivity for the conversion of heptane insolubles to lower molecular weight compounds under the relevant process conditions without excessive coking. An example of a catalyst suitable for use in this invention is a catalyst prepared by the addition of transition metals to a sepiolite carrier.

BRIEF DESCRIPTION OF THE DRAWING

The drawing illustrates suitable block form flow paths for practicing one embodiment of the present invention.

Particulate coal and solvent are blended in zone 10 to form a pumpable coal-solvent slurry. The slurry passes to dissolving stage 30 wherein the coal is substantially dissolved at an elevated temperature. Effluent from the dissolver is passed through a first catalytic reaction stage 50 which functions primarily to break down the heptane insolubles to lower molecular weight compounds. A portion of the effluent from the first reaction stage is recycled via line 60 to zone 10 for use as solvent. The remainder of the effluent is passed to second reaction stage 90 for further hydrogenation of the product. Effluent from reaction zone 90 passes to gas-liquid separator 110 where the light gases and oils are flashed off and the remaining liquid is passed through a solids separation zone 140 for removal of the coal residue.

DETAILED DESCRIPTION OF THE PREFERRED EMBODIMENTS

Referring to the drawing in detail, subdivided coal 5 and a lean hydrogen-donor solvent 60 are mixed in zone 10 to form a pumpable slurry. The basic feedstock of the present invention is a solid particulate coal such as anthracite,, bituminous coal, sub-bituminous coal, lignite, or mixtures thereof. The bituminous and sub-bituminous coals are particularly preferred, and it is also preferred that said coals be comminuted or ground to a particle size smaller than 100 mesh, Tyler standard sieve size, although larger coal sizes may be processed. The solvent used in zone 10 is a lean hydrogen-donor solvent which is processed-derived.

Hydrogen-donor solvents are known in the art and comprise polycyclic aromatic hydrocarbons such as tetrahydronaphthalene or dihydronaphthalene, which are capable of being at least partially saturated. After hydrogenation, these solvents can donate or transfer the acquired hydrogen to hydrogen-deficient dissolved coal molecules. As used herein, the term "lean" hydrogen-donor solvent refers to a hydrogen-donor solvent which is substantially depleted of donatable hydrogen at the pertinent process conditions and is therefore substantially inadequate for further hydrogen transfer. With such lean hydrogen-donor solvents, chemical interaction or hydrogen transfer between solvent and coal is minimal, although the solvent still possesses physical solvation properties. Generally a "lean" hydrogen-donor solvent will have a hydrogen to carbon molecular ratio of less than 1.2.

The subdivided coal is mixed or blended with the lean hydrogen-donor solvent in a solvent to coal weight ratio of from about 1:1 to 3:1, preferably from about 1:1 to 2:1.

The slurry from zone 10 is heated by conventional means such as process heat exchangers, steam coils or fired heaters, and passed via line 20 to dissolving zone 30. Dissolving zone 30 basically comprises an elongated vessel free of external catalyst or contact materials which provides sufficient residence time for the coal to dissolve or break up under the process conditions. The dissolver can be operated, for example, at a temperature in the range of about 400° to 480° C., and preferably 425° to 455° C., and at a pressure of about 1 to about 200 atmospheres. A satisfactory slurry hourly space velocity can be maintained in the dissolver, for example, about 1 to 150 hrs.$^{-1}$, and more preferably about 12 to 120 hrs.$^{-1}$. Since the present invention separates the initial coal break-up or dissolution from the dissolved coal hydrogenation steps, it is possible to operate the dissolver at the higher temperatures required for dissolution of the coal for a much shorter residence time than is used in the two-stage systems of the prior art. Operating the dissolver at a short residence time minimizes the hydrogen consumption and the light gas make and thereby increases the coal-liquid yields.

The physical structure of the dissolver per se is preferably designed so that the slurry may flow upwardly or downwardly therethrough. Preferably, the zone is baffled or sufficiently elongated to attain plug flow conditions, which permits the process of the present invention to be practiced on a continuous basis. Although the dissolver contains no catalyst or contact particles from any external source, the mineral matter contained in the coal may have some catalytic effect.

The mixture of dissolved coal, solvent and insoluble solids from dissolver 30 is fed through line 40 to a first catalytic reaction zone 50 containing a catalyst which is selective for converting heptane in soluble materials, including asphaltenes, to lower molecular weight compounds under the relevant process conditions without excessive coking.

It is well known that all coal liquefaction products from single-stage dissolvers contain what are commonly referred to as "asphaltenes". Traditionally, asphaltenes have been defined as hydrogen-deficient, high molecular weight hydrocarbonaceous materials which are insoluble in straight-chain aliphatic hydrocarbons, such as in pentane or in heptane and which are soluble in benzene. The product from the dissolver, however, also contains high molecular weight hydrocarbonaceous materials which are insoluble both in straight-chain aliphatic hydrocarbons and benzene. For this reason, these high molecular weight materials shall be referred to simply herein as "heptane insolubles".

For the catalyst in the second stage to possess a selectivity for heptane insoluble conversion, a high proportion (>than 40%) of its pore volume should normally be comprised of pores having diameters between 200 and 1000 Angstroms.

An example of a catalyst satisfactory for use in this invention is a catalyst prepared by the addition of transition metals to a sepiolite carrier. A preferred group of catalytically-active metals for use in said catalyst is the group including chromium, molybdenum, tungsten and vanadium. Preferably, one or more of these metals is present in the catalyst in an amount of 0.1 to 10 weight percent of the total catalyst weight, including the catalytically-active metal or metals. Another preferred group of catalytically-active metals for use for the catalyst is the group including iron, nickel and cobalt. Preferably, one or more of these metals is included in the catalyst particles in a total amount of from 0.1 to 10 weight percent of the total catalyst weight.

Particularly preferably, the catalyst particles include from 0.1 to 10 weight of at least one metal from both the preferred groups. Combinations of molybdenum and cobalt, molybdenum and nickel, tungsten and nickel, vanadium and nickel are examples. The catalytically-active metals may be present in reduced form or as one or more metal compounds, such as the oxide, sulfide or sulfate.

Hydrogen is also introduced via line 70 to the first catalytic reaction stage with the effluent from the dissolver. The temperature in the first stage can be, for example, in the range of 340° to 430° C. Other suitable reaction conditions include, for example, a pressure of 35 to 700 atmospheres of hydrogen partial pressure, preferably 70 to 210 atmospheres, and more preferably 100 to 170 atmospheres; a hydrogen rate of 355 to 3550 liters per liter of slurry, preferably 380 to 1780 liters of hydrogen per liter of slurry; and a slurry hourly space velocity in the range of 0.5 to 5 hrs.$^{-1}$.

The function of the first catalytic reactor stage lies primarily in converting the hydrocarbonaceous heptane insoluble molecules to lower molecular weight compounds. The effluent from the first stage catalytic reactor provides an excellent solvent for use in mixing zone 10 and a portion of said effluent is preferably recycled to said zone through line 60. It may be preferable to remove a portion of the coal residue from said slurry prior to recycle by filtration, centrifugation, settling, or the like.

The remainder of the effluent from reaction zone 50 passes via line 80 to a second catalytic reaction zone 90. In the second catalytic zone 90, hydrogenation and cracking occur simultaneously, and the higher molecular weight compounds are further hydrogenated and converted to lower molecular weight compounds. The sulfur from sulfur-containing compounds is converted to hydrogen sulfide, the nitrogen to ammonia, and the oxygen to water. Preferably, the catalytic reaction zone is a fixed bed type, although an ebullating or moving bed may be used. The mixture of gases, liquids and insoluble solids preferably passes upwardly through the catalytic reactor but may also pass downwardly.

The catalysts used in the second catalytic reaction zone may be any of the well known and commercially available hydrocracking catalysts. A suitable catalyst for use in the hydrocracking zone comprises a hydrogenation component and a mild cracking component. Preferably, the hydrogenation component is supported on a refractory, weakly acidic, cracking base. Suitable bases include, for example, silica, alumina, or composites of two or more refractory oxides such as silica-alumina, silica-magnesia, silica-zirconia, alumina-boria, silica-titania, silica-zirconia-titania, acid-treated clays, and the like. Acidic metal phosphates such as alumina phosphate may also be used. Preferred cracking bases comprise alumina and composites of silica and alumina. Suitable hydrogenation components are selected from Group VIb metals, Group VIII metals, and their oxides, sulfides, or mixtures thereof. Particularly preferred are cobalt-molybdenum, nickel-molybdenum or nickel-tungsten on alumina supports.

Any operable hydrocracking conditions can be used in the second catalytic zone. Preferably, the temperature in the hydrocracking zone is maintained below 430° C. and more preferably in the range of 340° to 400° C. to prevent fouling. The temperature in the hydrocracking zone should thus preferably be maintained below the temperature in the first catalytic zone and this may be accomplished by cooling the first catalytic reactor effluent by conventional methods such as indirect heat exchange with other process streams or by quenching with hydrogen. Other satisfactory hydrocracking conditions include a pressure of 35 to 700 atmospheres of hydrogen partial pressure, preferably 70 to 210 atmospheres and more preferably 100 to 170 atmospheres; a hydrogen rate of 355 to 3550 liters per liter of slurry, preferably 380 to 1780 liters of hydrogen per liter of slurry; and a slurry liquid hourly space velocity in the range 0.1 to 2/hr., preferably 0.2 to 0.5/hr.

Preferably, the pressure in all three reaction zones are substantially the same to eliminate interstage pumping. The effluent 100 from reaction zone 90 is preferably separated into a gaseous fraction 120 and a solids-liquid fraction 130 in separation zone 110. The gaseous fraction comprises light oils boiling below about 200° C. and normally gaseous components such as $H_2$, CO, $CO_2$, $H_2O$ and the $C_1$–$C_4$ hydrocarbons. Preferably, the $H_2$ is separated from the other gaseous components and recycled to the first catalytic reaction stage. The liquid-solids fraction 130 is fed to separation zone 140 wherein the coal residue may be separated by conventional methods, such as hydrocloning, filtering, centrifuging, gravity setting or any combination of said methods from the liquid product. Preferably, the insoluble solids are separated by gravity settling, which is an advantage of the present invention since the effluent from the hydrocracking reaction zone has a low viscosity and a relatively low specific gravity. The low gravity of the effluent allows rapdi separation of the solids by gravity settling such that generally 90 weight percent of the solids can be rapidly separated. Actual testing indicates that solid contents as low as 0.1 weight percent may be achieved with gravity settlers. Preferably, the insoluble solids are removed by gravity settling at an elevated temperature in the range 150° to 205° C. and at a pressure in the range 1 atmosphere to 340 atmospheres, more preferably 1 atmosphere to 70 atmospheres.

The process of the present invention produces extremely clean, normally liquid products. The normally liquid products, that is, all of the product fractions boiling above $C_4$, have an unusually low specific gravity; a low sulfur content of less than 0.1 weight percent; and a low nitrogen content of less than 0.5 weight percent.

As is readily apparent from the foregoing, the process of the present invention is simple and produces normally liquid products from coal which are useful for many purposes. The broad range product is particularly useful as a turbine fuel, while particular fractions are useful for gasoline, jet and other fuels.

What is claimed is:

1. A three-stage process for liquefying coal which comprises:

forming a coal-solvent slurry by mixing subdivided coal with a solvent;

passing said slurry through a dissolving stage to substantially dissolve said coal and produce an effluent comprising dissolved coal, solvent, insoluble solids, and heptane insolubles;

passing effluent containing the dissolved coal and the insoluble solids from said dissolving stage with added hydrogen through a first catalytic reaction stage containing a catalyst having a selectivity for converting heptane insolubles to lower molecular weight compounds, to convert heptane insolubles in said effluent from said dissolution stage to lower molecular weight compounds;

recycling a portion of the effluent from said first catalytic reaction stage for use as solvent; and passing remaining effluent from said first catalytic reaction stage through a second catalytic reaction stage containing hydrocracking catalyst and operating under hydrocracking conditions.

2. A three-stage process for liquefying coal is recited in claim 1, wherein said catalyst having a selectivity for converting heptane insolubles to lower molecular weight compounds comprises a catalytically-active transition metal supported on a sepiolite carrier.

3. A three-stage process for liquefying coal as recited in claim 2, further comprising: removing substantially all of the coal residue from the effluent which is recycled from said first catalytic reaction stage for use as solvent.

* * * * *